US008946976B2

(12) United States Patent
Kodama et al.

(10) Patent No.: US 8,946,976 B2
(45) Date of Patent: Feb. 3, 2015

(54) SPARK PLUG

(71) Applicant: NGK Spark Plug Co., Ltd., Nagoya-Shi, Aichi (JP)

(72) Inventors: Kazuhiro Kodama, Hekinan (JP); Hiroaki Nasu, Gifu (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 14/050,471

(22) Filed: Oct. 10, 2013

(65) Prior Publication Data

US 2014/0117833 A1 May 1, 2014

(30) Foreign Application Priority Data

Oct. 25, 2012 (JP) ..... 2012-235267

(51) Int. Cl.
*H01T 13/32* (2006.01)
*H01T 13/39* (2006.01)
*H01T 13/20* (2006.01)

(52) U.S. Cl.
CPC ..... *H01T 13/20* (2013.01)
USPC ..... 313/141; 313/118

(58) Field of Classification Search
CPC ..... H01T 13/20; H01T 13/32; H01T 21/02
USPC ..... 313/118–145
See application file for complete search history.

(56) References Cited

U.S. PATENT DOCUMENTS 6,750,597 B1 * 6/2004 Sakura ..... 313/141
8,087,961 B2 1/2012 Kameda et al. ..... 445/7
8,253,311 B2 * 8/2012 Ban et al. ..... 313/141
2001/0030494 A1 * 10/2001 Kanao ..... 313/141
2002/0163286 A1 * 11/2002 Nasu et al. ..... 313/143
2007/0046162 A1 * 3/2007 Moribe et al. ..... 313/143
2011/0148275 A1 * 6/2011 Taido et al. ..... 313/141
2013/0134858 A1 * 5/2013 Nasu et al. ..... 313/143

FOREIGN PATENT DOCUMENTS

JP 2003-123937 4/2003 ..... C22C 19/03
JP 2006-236906 9/2006 ..... H01T 13/20
JP 2012-015126 1/2012 ..... H01T 13/20

OTHER PUBLICATIONS

ISO 22977, "Road Vehicles—M12×1,25 Spark-Plugs with Flat Seating and 14 mm Bi-hexagon and their Cylinder Head Housing;" First edition Jul. 15, 2005; © 2005; 12 pages.

* cited by examiner

*Primary Examiner* — Anne Hines
*Assistant Examiner* — Christopher Raabe
(74) *Attorney, Agent, or Firm* — Kusner & Jaffe

(57) ABSTRACT

A spark plug includes a metal shell, a ground electrode joined to a front end portion of the metal shell and a nickel layer formed on the ground electrode, wherein the ground electrode has a base material exposed region in which a base material of the ground electrode is exposed; and wherein the nickel layer includes an outer-lateral-side nickel layer located on an outer lateral surface of the ground electrode at a position adjacent to the base material exposed region and satisfies a condition of LA≥25 μm, where LA is a length from a first part of the outer-lateral-side nickel layer having a thickness equal to 80% of a maximum thickness of the outer-lateral-side nickel layer to a second part of the outer-lateral-side nickel layer having a thickness equal to 20% of the maximum thickness of the outer-lateral-side nickel layer in a longitudinal direction of the ground electrode.

9 Claims, 5 Drawing Sheets

SPARK PLUG

FIELD OF THE INVENTION

The present invention relates to a spark plug for use in an internal combustion engine or the like.

BACKGROUND OF THE INVENTION

Hereinafter, the term "front" refers to a spark discharge side with respect to the direction of an axis of a spark plug; and the term "rear" refers to a side opposite the front side.

A spark plug is mounted to an internal combustion engine (sometimes simply referred to as "engine") etc. and used to ignite an air-fuel mixture in a combustion chamber of the engine. The spark plug generally includes an insulator formed with an axial hole in the direction of an axis of the spark plug, a center electrode inserted in a front side of the axial hole, a metal shell arranged on an outer circumference of the insulator and a ground electrode joined to a front end portion of the metal shell. The ground electrode is bent at a substantially middle portion thereof toward the center electrode such that a distal end portion of the ground electrode faces a front end portion of the center electrode to define a spark discharge gap between the distal end portion of the ground electrode and the front end portion of the center electrode.

For improvements in the corrosion resistance of the metal shell and the ground electrode, there is a case where a thin coating layer of nickel-based metal material (hereinafter simply referred to as "nickel layer") is applied to surfaces of the metal shell and the ground electrode. It is common practice to join the ground electrode to the metal shell, and then, apply the nickel layer to the resulting joined unit by a plating process. In this case, the nickel layer is formed on the entire surfaces of the metal shell and the ground electrode.

The nickel layer may be separated when the ground electrode coated with the nickel layer is subjected to bending. The occurrence of such separation of the nickel layer becomes a cause of abnormal spark discharge, called "lateral spark", between the separated part of the nickel layer and the center electrode and leads to deterioration in the ignition performance of the spark plug.

Further, there is recently a case where a tip of highly wear-resistant metal material is bonded to the distal end portion of the ground electrode for improvements in the wear resistance of the ground electrode and in the ignition performance of the spark plug. However, the bondability of the tip to the ground electrode may not be sufficient when the tip bonding site of the ground electrode is being coated with the nickel layer. It is thus conceivable to remove the nickel layer from at least the distal end portion of the ground electrode. For example, Japanese Laid-Open Patent Publication No. 2003-123937 discloses a technique of removing the nickel layer by grinding using a given grinding jig. Japanese Laid-Open Patent Publication No. 2012-15126 teaches a technique of applying a masking layer to at least the distal end portion of the ground electrode before the plating process and, after the plating process, removing the nickel layer along with the masking layer.

SUMMARY OF THE INVENTION

In the above nickel layer removing techniques, a boundary region of the nickel layer (generated by nickel removal treatment such as grinding etc. adjacent to a base material exposed region of the ground electrode) may abruptly changes in thickness. Among the nickel layer, the outer-lateral-side nickel layer (i.e. the outer lateral portion of the nickel layer located on the outer lateral surface of the ground electrode opposite from the center electrode) is particularly subjected to high-temperature conditions during operation of the internal combustion engine.

In the case where the boundary region of the nickel layer abruptly changes in thickness, the boundary region of the outer-lateral-side nickel layer cannot follow deformation (expansion or contraction) of the ground electrode caused due to heating/cooling cycles during operation of the internal combustion engine so that there occurs a large stress difference between the outer-lateral-side nickel layer and the ground electrode. Similarly, the boundary region of the outer-lateral-side nickel layer cannot follow bending of the ground electrode so that there occurs a large stress difference between the outer-lateral-side nickel layer and the ground electrode in the case where the boundary region of the nickel layer abruptly changes in thickness. By such a large stress difference, the boundary region of the outer-lateral-side nickel layer may be separated from the ground electrode and get into the spark discharge gap to thereby interfere with proper spark discharge of the spark plug.

In view of the above circumstances, it is an object of the present invention to provide a spark plug having a nickel layer applied to a ground electrode so as to effectively reduce a stress difference between the nickel layer (notably, outer-lateral-side nickel layer) and the ground electrode and assuredly prevent separation of the nickel layer from the ground electrode.

The present invention provides the following configurations.

Configuration 1:

A spark plug, comprising:

a cylindrical metal shell;

a ground electrode joined to a front end portion of the metal shell; and a nickel layer formed on the ground electrode, wherein the ground electrode has a base material exposed region in which a base material of the ground electrode is exposed; and wherein the nickel layer includes at least an outer-lateral-side nickel layer located on an outer lateral surface of the ground electrode so as to be adjacent to the base material exposed region of the ground electrode and satisfies a condition of $LA \geq 25\ \mu m$, where LA is a length from a first part of the outer-lateral-side nickel layer having a thickness equal to 80% of a maximum thickness of the outer-lateral-side nickel layer to a second part of the outer-lateral-side nickel layer having a thickness equal to 20% of the maximum thickness of the outer-lateral-side nickel layer in a longitudinal direction of the ground electrode.

According to configuration 1, a boundary region of the outer-lateral-side nickel layer adjacent to the base material exposed region is gradually decreased in thickness toward the base material exposed region so that, when the ground electrode gets deformed (expanded or contracted) due to heating/cooling cycles or bending, the boundary region of the outer-lateral-side nickel layer can be easily deformed to follow the deformation of the ground electrode. It is thus possible to adequately reduce the stress difference between the outer-lateral-side nickel layer and the ground electrode and assuredly prevent the outer-lateral-side nickel layer from being separated from the ground electrode.

Configuration 2:

The spark plug according to configuration 1, wherein the nickel layer satisfies a condition of $LA \geq 50\ \mu m$.

It is possible according to configuration 2 to further reduce the stress difference between the outer-lateral-side nickel layer and the ground electrode and effectively and assuredly prevent separation of the outer-lateral-side nickel layer.

Configuration 3:

The spark plug according to configuration 1 or 2, wherein the nickel layer satisfies a condition of LA≥90 μm.

It is possible according to configuration 3 to still further reduce the stress difference between the outer-lateral-side nickel layer and the ground electrode and more effectively and assuredly prevent separation the outer-lateral-side nickel layer.

Configuration 4:

A spark plug, comprising:

a cylindrical metal shell;

a ground electrode joined to a front end portion of the metal shell; and a nickel layer formed on the ground electrode, wherein the ground electrode has a base material exposed region in which a base material of the ground electrode is exposed; and wherein the nickel layer includes at least an outer-lateral-side nickel layer located on an outer lateral surface of the ground electrode so as to be adjacent to the base material exposed region of the ground electrode and satisfies a condition of LB≥0.25 mm, where, assuming that the outer-lateral-side nickel layer has, at a first part thereof, a thickness equal to 80% of a maximum thickness of the outer-lateral-side nickel layer, LB is a length between points of the first part of the outer-lateral-side nickel layer located closest to and farthest away from a front end of the metal shell in a longitudinal direction of the ground electrode.

According to configuration 4, a boundary line between the outer-lateral-side nickel layer and the base material exposed region is made sufficiently long so that the stress per unit length on the boundary region of the outer-lateral-side nickel layer can be decreased to a sufficiently small level. It is thus possible to, even in the case where the boundary region of the outer-lateral-side nickel layer abruptly changes in thickness, adequately reduce the stress difference between the outer-lateral-side nickel layer and the ground electrode and assuredly prevent the outer-lateral-side nickel layer from being separated from the ground electrode.

Configuration 5:

The spark plug according to configuration 4, wherein the nickel layer satisfies a condition of LB≥0.40 mm.

It is possible according to configuration 5 to further reduce the stress difference between the outer-lateral-side nickel layer and the ground electrode and effectively and assuredly prevent separation of the outer-lateral-side nickel layer as the stress per unit length of the boundary region of the outer-lateral-side nickel layer can be decreased to a smaller level.

Configuration 6:

The spark plug according to configuration 4 or 5, wherein the nickel layer satisfies a condition of LB≥0.80 mm It is possible according to configuration 5 to still further reduce the stress difference between the outer-lateral-side nickel layer and the ground electrode and more effectively and assuredly prevent separation the outer-lateral-side nickel layer as the stress per unit length of the boundary region of the outer-lateral-side nickel layer can be decreased to a very smaller level.

Configuration 7:

The spark plug according to any one of configurations 4 to 6, wherein the nickel layer satisfies a condition of LA≥25 μm where LA is a length from the first part of the outer-lateral-side nickel layer to a second part of the outer-lateral-side nickel layer having a thickness equal to 20% of the maximum thickness of the outer-lateral-side nickel layer in the longitudinal direction of the ground electrode.

It is possible according to configuration 7 to prevent separation of the outer-lateral-side nickel layer effectively and assuredly by the synergistic effect of configuration 1 and configuration 4, 5 or 6.

Configuration 8:

The spark plug according to configuration 7, wherein the nickel layer satisfies a condition of LA≥50 μm.

It is possible according to configuration 8 to prevent separation of the outer-lateral-side nickel layer more effectively and assuredly by the synergistic effect of configuration 2 and configuration 4, 5 or 6.

Configuration 9:

The spark plug according to configuration 7 or 8, wherein the nickel layer satisfies a condition of LA≥90 μm.

It is possible according to configuration 9 to prevent separation of the outer-lateral-side nickel layer particularly effectively and assuredly by the synergistic effect of configuration 3 and configuration 4, 5 or 6.

The other objects and features of the present invention will also become understood from the following description.

DETAILED DESCRIPTION OF PREFERRED EMBODIMENTS

The present invention will be described in detail below with reference to the drawings.

Herein, the following exemplary embodiment specifically refers to a spark plug 1 for use by mounting to a combustion apparatus (such as an internal combustion engine or a fuel cell processing device). It is noted that the direction of an axis CL1 of the spark plug 1 corresponds to the vertical direction of FIG. 1 where the front and rear sides of the spark plug 1 are shown on the bottom and top sides of FIG. 1, respectively.

Figure 1:
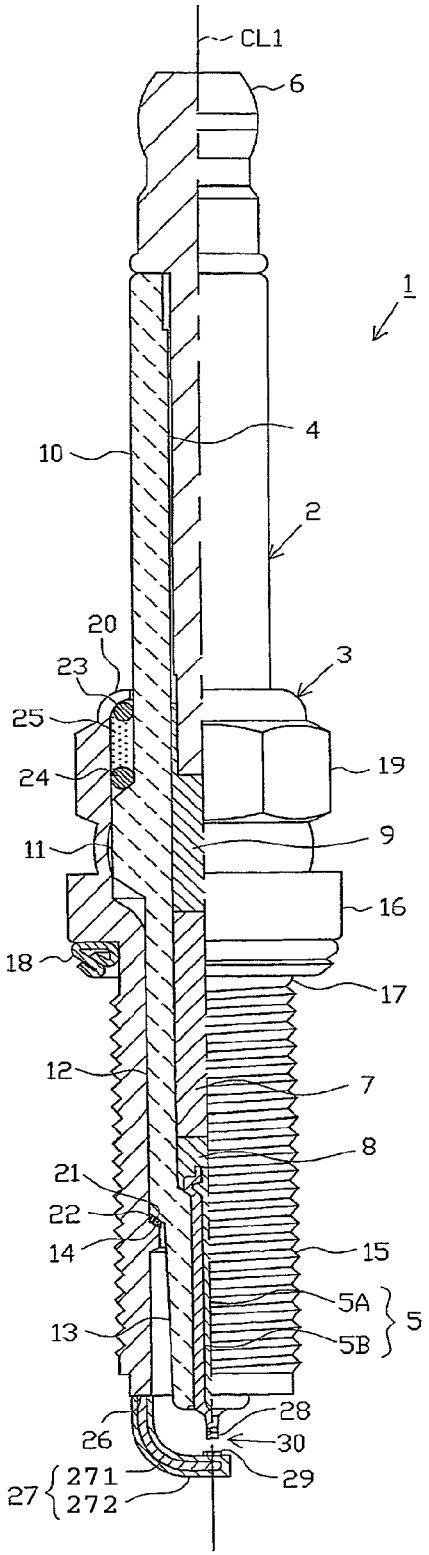
FIG. 1 is an elevation view, partially in section, of a spark plug according to one exemplary embodiment of the present invention.

As shown in FIG. 1, the spark plug 1 includes a ceramic insulator 2 as a cylindrical insulator and a cylindrical metal cell 3 holding therein the ceramic insulator 2.

The ceramic insulator 2 is made of sintered alumina as is generally known and has an outer shape including a rear body portion 10 formed on a rear side thereof, a large-diameter portion 11 formed front of the rear body portion 10 and protruding radially outwardly, a middle body portion 12 formed front of the large-diameter portion 11 and made smaller in diameter than the large-diameter portion 11 and a leg portion 13 formed front of the middle body portion 12 and made smaller in diameter than the middle body portion 12. The large-diameter portion 11, the middle body portion 12 and major part of the leg portion 13 of the ceramic insulator 2 are accommodated in the metal shell 3. When the spark plug 1 is placed in position on the combustion apparatus, the leg portion 13 is exposed to a combustion chamber of the combustion apparatus. The ceramic insulator 2 also has a tapered step portion 14 formed between the middle body portion 12 and the leg portion 13 such that the ceramic insulator 2 can be held in the metal shell 3 by means of the step portion 14. Further, an axial hole 4 is formed through the ceramic insulator 2 in the direction of the axis CL1.

A center electrode 5 is inserted and fixed in a front side of the axial hole 4. In the present embodiment, the center electrode 5 has an inner layer 5A made of high-thermal-conductivity metal material (such as copper (Cu), copper alloy or pure nickel (Ni)) and an outer layer 5B made of Ni-based alloy. The center electrode 5 is formed as a whole into a rod shape (cylindrical column shape) and held in the ceramic insulator 2 with a front end portion of the center electrode 5 protruding from a front end of the ceramic insulator 2.

For improvement in wear resistance, a cylindrical tip 28 of predetermined metal material (e.g. iridium (Ir), platinum (Pt), rhodium (Rh), ruthenium (Ru), rhenium (Re), tungsten (W), palladium (Pd) or an alloy containing at least one thereof) is joined to the front end portion of the center electrode 5.

A terminal electrode 6 is inserted and fixed in a rear side of the axial hole 4 with a rear end portion of the terminal electrode 6 protruding from a rear end of the ceramic insulator 2.

A cylindrical column-shaped resistive element 7 is disposed between the center electrode 5 and the terminal electrode 6 within the axial hole 4 and is electrically connected at opposite ends thereof to the center electrode 5 and the terminal electrode 6 through conductive glass seal layers 8 and 9, respectively.

The metal shell 3 is made of metal material such as low carbon steel and formed into a cylindrical shape in the direction of the axis CL1. The metal shell 3 has, on an outer circumferential surface thereof, a thread portion (male thread portion) 15 formed for mounting the spark plug 1 in a mounting hole of the combustion apparatus and a seat portion 16 formed rear of the thread portion 15 and protruding radially outwardly. A ring-shaped gasket 18 is fitted around a thread neck 17 on a rear end of the thread portion 15. The metal shell 3 also has, on a rear end side thereof, a tool engagement portion 19 formed into a hexagonal cross section for engagement with a tool such as wrench for mounting the spark plug 1 to the combustion apparatus and a crimped portion 20 formed rear of the tool engagement portion 19 and bent radially inwardly so as to hold therein the ceramic insulator 2 the metal shell 3. Further, the metal shell 3 has a tapered step portion 21 formed on an inner circumferential surface thereof so as to hold thereon the ceramic insulator 2.

The ceramic insulator 2 is inserted in the metal shell 3 from the rear toward the front and fixed in the metal shell 3 by crimping an open rear end portion of the metal shell 3 radially inwardly and thereby forming the crimped portion 20, with the step portion 14 of the ceramic insulator 2 retained on the step portion 21 of the metal shell 3. An annular plate packing 22 is disposed between the step portions 14 and 21 so as to maintain the gas tightness of the combustion chamber and prevent the leakage of fuel gas to the outside through a space between the inner circumferential surface of the metal shell 3 and the leg portion 13 of the ceramic insulator 2.

In order to secure more complete seal by crimping, annular ring members 23 and 24 are disposed between the metal shell 3 and the ceramic insulator 2 within the rear end portion of the metal shell 3; and the space between the ring members 23 and 34 is filled with a powder of talc 25. In other words, the metal shell 3 holds therein the ceramic insulator 2 via the plate packing 22, the ring members 23 and 24 and the talc 25.

Figure 2:
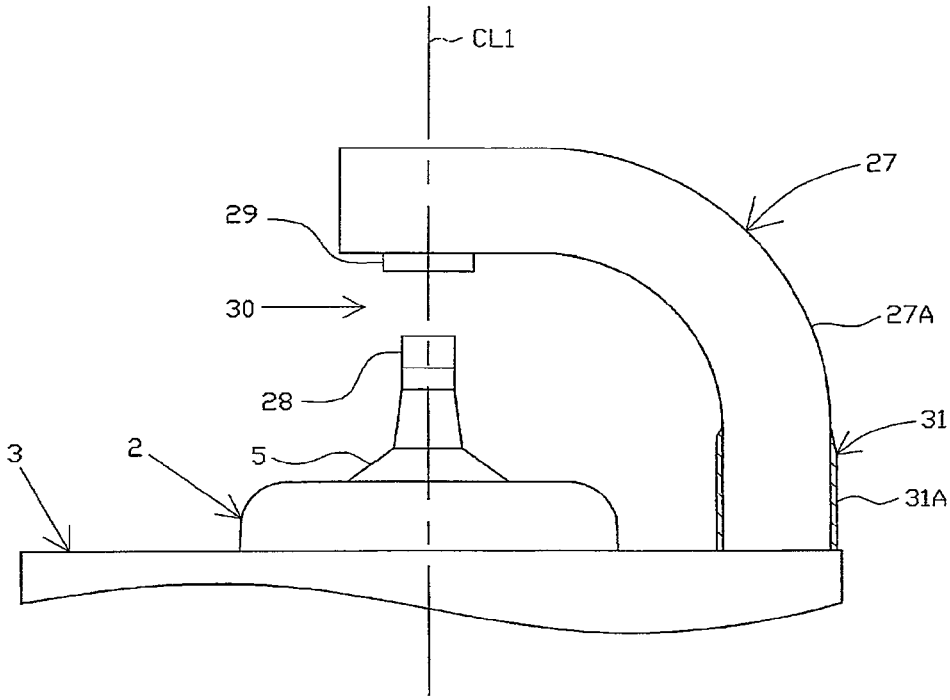
FIG. 2 is an enlarged elevation view of a front end part of the spark plug according to the one exemplary embodiment of the present invention.

As shown in FIGS. 1 and 2, a ground electrode 27 is joined at a base end portion thereof to a front end portion 26 of the metal shell 3 and bent at a substantially middle portion thereof such that a distal end portion of the ground electrode 27 faces the front end portion of the center electrode 5. In the present embodiment, the ground electrode 27 has an outer layer 271 made of Ni-based alloy (such as Inconel 600 or Inconel 601 (each is a trade name)) and an inner layer 272 made of metal material (such as pure Cu or Cu-based alloy) higher in conductivity than Ni-based alloy.

For improvement in wear resistance, a cylindrical tip 29 of predetermined metal material (e.g. iridium (Ir), platinum (Pt), rhodium (Rh), ruthenium (Ru), rhenium (Re), tungsten (W), palladium (Pd) or an alloy containing at least one thereof) is joined by resistance welding to the distal end portion of the ground electrode 27.

There is defined a spark discharge gap 30 between the tips 28 and 29. By the application of a high voltage to the spark discharge gap 30, a spark discharge is generated in the spark discharge gap 30 substantially along the direction of the axis CL1.

As shown in FIG. 2, a thin coating layer 31 of Ni-based metal material (simply referred to as "nickel layer") is applied to an outer circumference of the base end portion of the ground electrode 27. It is herein noted that, in FIG. 2, the nickel layer 31 is illustrated thicker than the actual size for the sake of convenience. Further, the term "nickel-based metal material" refers to a metal material in which nickel has the highest mass ratio among constituent elements.

In the present embodiment, the nickel layer 31 is formed by applying a plating film of Ni-based metal material onto the entire outer surface of the ground electrode and removing (stripping off) the plating film from at least the distal end portion of the ground electrode 27. The method of removing the plating film will be discussed in detail later.

Upon removal of the plating film, the ground electrode 27 has, formed adjacent to the nickel layer 31, a base material exposed region 27A in which the base material (the alloy material of the outer layer 271) of the ground electrode 27 is exposed. In the present embodiment, the tip 29 is welded to the base material exposed region 27A of the ground electrode 27. It is thus possible to attain good welding strength of the tip 29 to the ground electrode 27 and thereby possible to prevent separation (fall-off) of the tip 29 from the ground electrode 27. Further, it is possible to bend the ground electrode 27 without causing separation of the nickel layer 31 by removing the plating film from the bending site of the ground electrode 27.

Figure 3:
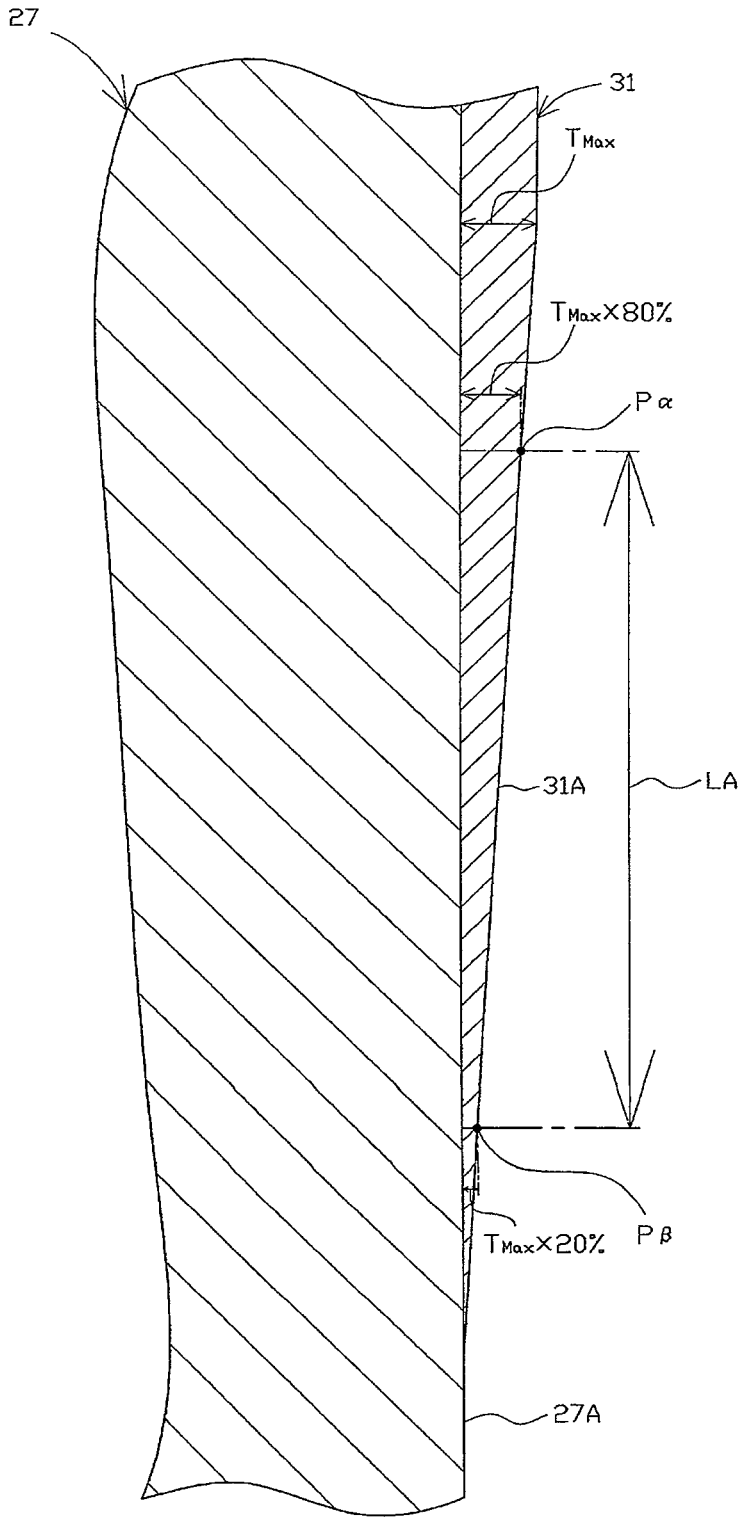
FIGS. 3 and 4 are an enlarged section view and an enlarged side view showing an outer lateral part of a nickel layer in the spark plug according to the one exemplary embodiment of the present invention, respectively.

As shown in FIGS. 2 and 3, the nickel layer 31 includes an outer-lateral-side nickel layer 31A formed on the outer lateral surface of the ground electrode 27 (opposite from the center electrode 5) such that a boundary region of the outer-lateral-side nickel layer 31 adjacent to the base material exposed region 27A is gradually decreased in thickness toward the base material exposed region 27A. More specifically, the nickel layer 31 is so configured as to satisfy the condition of LA≥25 μm where LA is, in a cross section taken through the base end portion of the ground electrode 27 and including the axis CL1 as shown in FIG. 3, a length from a part Pα of the outer-lateral-side nickel layer 31A having a thickness equal to 80% of the maximum thickness $T_{Max}$ of the outer-lateral-side nickel layer 31A to a part Pβ of the outer-lateral-side nickel layer 31A having a thickness equal to 20% of the maximum thickness $T_{Max}$ of the outer-lateral-side nickel layer 31A in a longitudinal direction of the ground electrode 27. In view of the fact that the larger the length LA, the less likely the separation of the outer-lateral-side nickel layer 31A will occur, it is preferable to satisfy the condition of LA≥50 μm, still more preferably LA≥90 μm.

In the present embodiment, the maximum thickness $T_{Max}$ is controlled to within a given range (e.g. 3 to 40 μm). Herein, the thickness of the nickel layer 31 can be measured with a predetermined metallurgical microscope (such as "BX51M" manufactured by Olympus Corporation).

Figure 4:
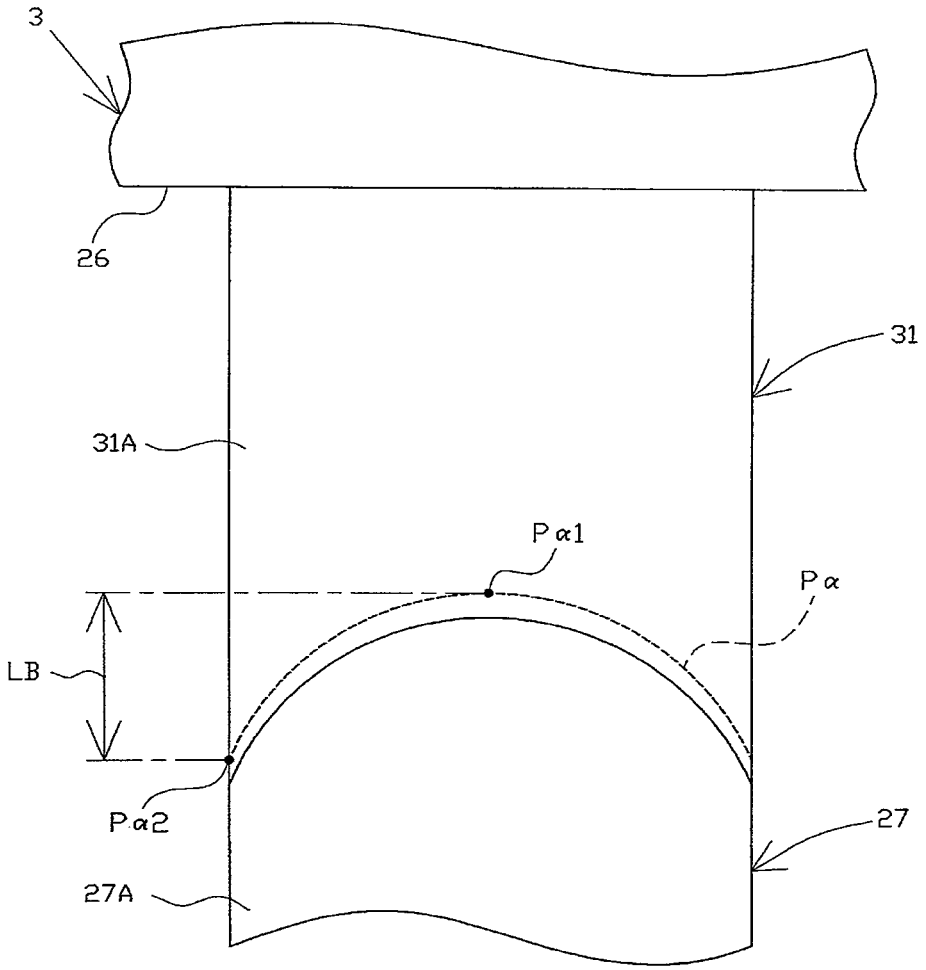

Further, a boundary line between the outer-lateral-side nickel layer 31A and the base material exposed region 27A is curved into a convex shape toward the front end portion 26 of the metal shell 3 as shown in FIG. 4. In consequence, the part Pα of the outer-lateral-side nickel layer 31A is convex-curved toward the front end portion 26 of the metal shell 3. The nickel layer 31 is then so configured as to satisfy the condition of LB≥0.25 mm where LB is a length between points Pα1 and Pα2 of the part Pα of the outer-lateral-side nickel layer 31A located closest to and farthest away from the front end portion 26 of the metal shell 3 in the longitudinal direction of the ground electrode 27. Namely, the boundary line between the outer-lateral-side nickel layer 31A and the base material exposed region 27A is made sufficiently long. In view of the fact that the larger the length LB, the less likely the separation of the outer-lateral-side nickel layer 31A will occur, it is preferable to satisfy the condition of LB≥0.40 mm, still more preferably LB≥0.80 mm In the present embodiment, the nickel layer 31 formed on side surfaces between the outer lateral surface and inner lateral surface of the ground electrode 27 (facing the center electrode 5) is the same in configuration to the outer-lateral-side nickel layer 31A.

The above-structured spark plug 1 can be manufactured by the following procedure.

First, the metal shell 3 is produced in advance. More specifically, a semifinished metal shell member is provided by cold forging a cylindrical column-shaped metal material (such as iron-based material e.g. S17C or S25C or stainless steel material) to form a through hole in the metal material and to form the metal material into a general shape, and then, cutting the outside shape of the metal material.

The ground electrode 27 is produced from a Ni-based alloy material in straight rod form and joined by resistance welding to a front end face of the semifinished metal shell member. There occurs burr during the welding process. After removing the welding burr, the thread portion 15 is formed by component rolling on a given area of the semifinished metal shell member. There is thus obtained a welded unit of the metal shell 3 and the ground electrode 27.

The welded unit of the metal shell 3 and the ground electrode 27 is given nickel plating by a barrel plating process. This plating process is performed with the use of a barrel plating apparatus (not shown). The barrel plating apparatus generally includes a plating bath storing therein an aqueous plating solution, which contains nickel sulfate ($NiSO_4$) or nickel chloride ($NiCl_2$), boric acid ($H_3BO_3$) etc. and shows a certain acidity (of the order of pH 3.7±0.5), and a holder having a wall surface formed of mesh, perforated plate etc. and being immersed in the aqueous plating solution. The welded unit of the metal shell 3 and the ground electrode 27 is accommodated in the holder and thereby immersed in the aqueous plating solution. Then, the Ni-based plating film is formed on the entire outer surfaces of the ground electrode 27 and the metal shell 3 by supplying a direct current to the ground electrode 27 and the metal shell 3 for a predetermined time while rotating the holder with a given motor.

The thickness of the plating film can be controlled by adjusting the current supply time and current density ($A/dm^2$) during the plating process.

Figure 5:
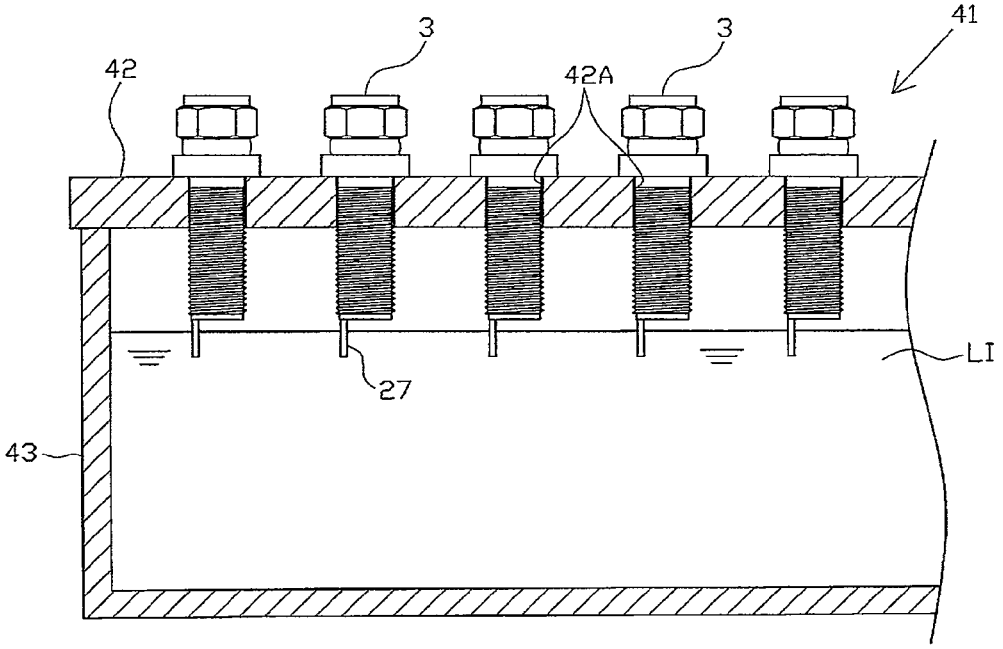
FIG. 5 is a schematic section view showing a step of removing a nickel plating film in a plating film removing apparatus for the formation of the nickel layer.

Subsequently, the plating film is removed (stripped off) from at least the distal end portion of the ground electrode 27 with the use of a plating film removing apparatus 41 as shown in FIG. 5. The plating film removing apparatus 41 includes a plate-shaped holding jig 42 formed with a plurality of holding holes 42A and a stripping solution bath 43 storing therein a plating stripping solution L1, which contains a nitro compound, a carbonate compound, an amine compound etc. The metal shell 3 is held in the holding jig 42, with the front end portion 26 of the metal shell 3 directed toward the bottom, by passing a front part of the metal shell 3 through the holding hole 42A and bringing the seat portion 16 of the metal shell 3 into contact with an upper side of the holding jig 42. In this state, the distal end portion of the ground electrode 27 are immersed in the plating stripping solution L1 within the stripping solution bath 43 for a predetermined time (e.g. 10 minutes). Then, the part of the plating film immersed in the plating stripping solution L1 is removed (stripped off) from the surface of the ground electrode 27. As a result, the nickel layer 31 is formed on the distal end portion of the ground electrode 27.

The lengths LA and LB of the nickel layer 31 can be controlled by adjusting the concentration of the nitro compound etc. in the plating stripping solution L1 and the temperature of the plating stripping solution L1. For example, the lengths LA and LB can be increased by increasing the concentration of the plating stripping solution L1 and by decreasing the temperature of the plating stripping solution L1 due to the fact that the surface tension of the plating stripping solution L1 increases with increase in concentration and with decrease in temperature. The lengths LA and LB of the nickel layer 31 can also be controlled by adjusting the viscosity of the plating stripping solution L1 and thereby changing the surface tension of the plating stripping solution L1. The removal of the plating film may be performed by immersing the ground electrode 27 in the plating stripping solution L1 under the supply of an electric current.

After the removal of the plating film, the ground electrode 27 is subjected to washing and drying in a state where the metal shell 3 is kept held in the holding jig 42.

The ceramic insulator 2 is produced separately from the metal shell 3. It is, for example, feasible to produce the ceramic insulator 2 by preparing a granulated molding material from an alumina-based raw powder with a binder etc., rubber-press molding the prepared material into a cylindrical body, shaping by cutting the outside shape of the molded body, and then, sintering the molded body.

The center electrode 5 is also produced separately from the metal shell 3 and the ceramic insulator 2, by forging an alloy material in which a copper alloy etc. for improvement in thermal radiation performance is placed in the center of the Ni-based alloy. Further, the tip 28 is joined to the front end portion of the center electrode 5 by e.g. laser welding The ceramic insulator 2, the center electrode 5, the resistive element 7 and the terminal electrode 6 are fixed together by the glass seal layers 8 and 9. In general, a material of the glass seal layer 8, 9 is prepared by mixing a borosilicate glass with a metal powder. The prepared material is filled into the axial hole 4 of the ceramic insulator 2 in such a manner as to sandwich therebetween the resistive element 7. The filled material is solidified by firing in a firing furnace, with the terminal electrode 6 pressed into the filled material from the rear. The center electrode 5, the terminal electrode 6 and the like are then fixed in position within the ceramic insulator 2.

At this time, a glazing layer may be formed simultaneously, or in advance, on a surface of the rear body portion 10 of the ceramic insulator 2.

The resulting subassembly of the ceramic insulator 2, the center electrode 5 and the terminal electrode 6 is assembled and fixed with the welded unit of the metal shell 3 and the ground electrode 27 by inserting the ceramic insulator 2 in the metal shell 3 from the rear end side and crimping the open rear end of the metal shell 3 radially inwardly (i.e. forming the crimped portion 20).

The tip 29 is joined by resistance welding to the distal end portion (base material exposed region 27A) of the ground electrode 27.

Finally, the spark plug 1 is completed by bending the ground electrode 27 and adjusting the spark discharge gap 30 between the tips 28 and 29.

As described above, the nickel layer 31 is so configured as to satisfy the condition of LA≥25 μm in the present embodiment. In this configuration, the boundary region of the outer-lateral-side nickel layer 31A adjacent to the base material exposed region 27A is gradually decreased in thickness toward the base material exposed region 27A so that, when the ground electrode 27 gets deformed (expanded or contracted) due to heating/cooling cycles or bending, the boundary region of the outer-lateral-side nickel layer 31A can be easily deformed to follow the deformation of the ground electrode 27. It is thus possible to adequately reduce the stress difference between the outer-lateral-side nickel layer 31A and the ground electrode 27 and assuredly prevent the outer-lateral-side nickel layer 31A from being separated from the ground electrode 27.

Further, the nickel layer 31 is so configured as to satisfy the condition of LB≥0.25 mm in the present embodiment. In this configuration, the boundary line between the outer-lateral-side nickel layer 31A and the base material exposed region 27A is made sufficiently long so that the stress per unit length on the boundary region of the outer-lateral-side nickel layer 31A can be decreased to a sufficiently small level. It is thus possible by the synergistic effect of LA≥25 μm and LB≥0.25 mm to adequately reduce the stress difference between the outer-lateral-side nickel layer 31A and the ground electrode 27 and assuredly prevent the outer-lateral-side nickel layer 31A from being separated from the ground electrode 27.

In the present embodiment, the nickel layer 31 formed on the side surfaces of the ground electrode 27 can also exert the above effects. This leads to more assured prevention of separation of the nickel layer 31.

In order to verify the functions and effects of the above embodiment, samples of spark plugs having various lengths LA (100 samples for each LA) were prepared. Herein, the length LA was set to various values by adjusting the component concentration of the plating stripping solution at the time of stripping (removal) of the plating film. Further, the pH of the plating stripping solution was 10; the temperature of the plating stripping solution was 60° C.; and the time of immersion of the ground electrode in the plating stripping solution was 10 minutes.

Figure 6:
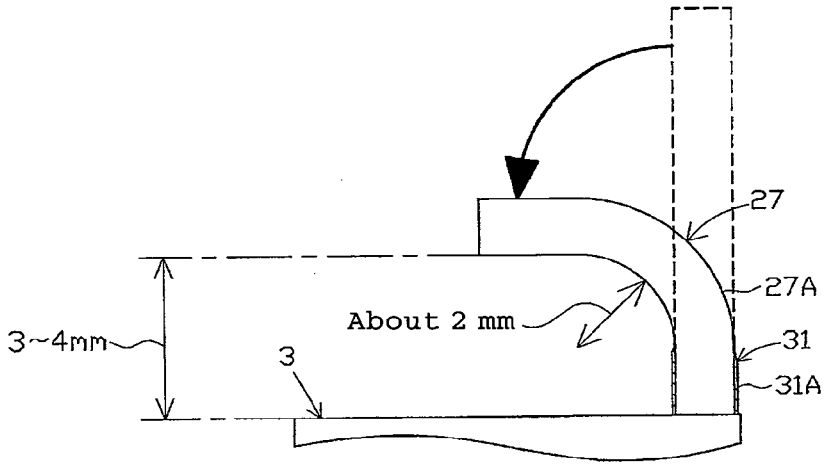
FIG. 6 is a schematic view showing a state of bending of a ground electrode in a separation resistance evaluation test.

The above-prepared spark plug samples were each tested for the separation resistance of the nickel layer by the following separation resistance evaluation test. In each sample, the ground electrode was heated at 1000° C. for 15 minutes, cooled down to room temperature, and then, subjected to bending operation. The bending operation was conducted by bending the ground electrode in such a manner as to control the distance between the distal end of the ground electrode and the front end of the metal shell to be 3 to 4 mm and control the radius of bending of the ground portion to be about 2 mm as shown in FIG. 6. After the bending operation, the ground electrode 27 was observed visually or with the use of a magnifier of 10 times magnification to check the occurrence or non-occurrence of a separation defect (e.g. crack etc.) in the nickel layer. The separation resistance of the nickel layer was evaluated as: "excellent (☆☆☆)" when the nickel layer had no separation defect in all of 100 samples; "very good (☆☆)" when the nickel layer had a separation defect of smaller than 1 mm diameter in only one out of 100 samples; "good (☆)" when the nickel layer had a separation defect of smaller than 1 mm diameter in only two out of 100 samples; "favorable (◎)" when the nickel layer had a separation defect of smaller than 1 mm diameter in only three out of 100 samples; "acceptable (○)" when the nickel layer had a separation defect of smaller than 1 mm diameter in four out of 100 samples or when the nickel layer had a separation defect of 1 mm or larger diameter in any one out of 100 samples; and "bad (x)" when the nickel layer had a separation defect of smaller than 1 mm diameter in five or more out of 100 samples or when the nickel layer had a separation defect of 1 mm or larger diameter in two or more out of 100 samples.

The test results of the samples are shown in TABLE 1.

TABLE 1

| Heating temperature: 1000° C. | | | | | | | | |
|---|---|---|---|---|---|---|---|---|
| | Length LA (μm) | | | | | | | |
| | 20 | 25 | 50 | 90 | 300 | 500 | 1000 | 1100 |
| Separation resistance evaluation result | X | ☆ | ☆☆ | ☆☆☆ | ☆☆☆ | ☆☆☆ | ☆☆☆ | ☆☆☆ |

As shown in TABLE 1, the separation resistance of the nickel layer was good when the length LA was greater than or equal to 25 μm. The reason for this is assumed that, as the boundary region of the outer-lateral-side nickel layer adjacent to the base material exposed region was not abruptly changed but was gradually decreased in thickness toward the base material exposed region, it was possible to allow the boundary region of the outer-lateral-side nickel layer to be deformed in response to deformation (expansion or contraction) of the ground electrode under heating/cooling cycles and bending and thereby possible to reduce the stress difference between the outer-lateral-side nickel layer and the ground electrode to a sufficiently small level.

When the length LA was greater than or equal to 50 μm, the separation resistance of the nickel layer was improved to a higher level. The separation resistance of the nickel layer was improved to a further higher level when the length LA was greater than or equal to 90 μm.

It has thus been shown by the above test results that it is preferable to control the length LA to be greater than or equal to 25 μm, more preferably 50 μm or more, still more preferably greater than or equal to 90 μm, for improvement in separation resistance.

Next, samples of spark plugs having various lengths LB (100 samples for each LB) were prepared. Herein, the length LA was set to 25 μm or 90 μm by adjusting the component concentration of the plating stripping solution; and the length LB was set to various values by adjusting the temperature of the plating stripping solution at the time of stripping (removal) of the plating film. Further, the pH of the plating stripping solution was 10; and the time of immersion of the ground electrode in the plating stripping solution was 10 minutes.

The above-prepared spark plug samples were then each tested by the separation resistance evaluation test. The separation resistance evaluation test was carried out in the same manner as above, except that the heating temperature was changed from 1000° C. to 1050° C. in order to test each sample in the environment where there was more likely to occur separation of the nickel layer from the ground electrode.

The test results of the samples where the length LA was 25 μm are shown in TABLE 2; and the test results of the samples where the length LA was 90 μm are shown in TABLE 3.

TABLE 2

| Heating temperature: 1050° C., Length LA: 25 μm | | | | | | |
|---|---|---|---|---|---|---|
| | Length LB (mm) | | | | | |
| | 1.70 | 1.60 | 0.80 | 0.40 | 0.25 | 500 |
| Separation resistance evaluation result | ☆☆☆ | ☆ | ☆ | ◎ | ○ | X |

TABLE 3

| Heating temperature: 1050° C., Length LA: 90 μm | | | | | | |
|---|---|---|---|---|---|---|
| | Length LB (mm) | | | | | |
| | 1.70 | 1.60 | 0.80 | 0.40 | 0.25 | 500 |
| Separation resistance evaluation result | ☆☆☆ | ☆☆☆ | ☆☆☆ | ☆☆ | ☆ | X |

As shown in TABLES 2 and 3, the separation resistance of the nickel layer was good, even in the severe environment where there was more likely to occur separation of the nickel layer from the ground electrode, when the length LB was greater than or equal to 0.25 mm. The reason for this is assumed that, as the boundary line between the outer-lateral-side nickel layer and the base material exposed region was made relatively long, it was possible to decrease the stress per unit length on the boundary region of the outer-lateral-side nickel layer to a sufficiently small level for further reduction of the stress difference between the outer-lateral-side nickel layer and the ground electrode.

When the length LB was greater than or equal to 0.40 mm, the separation resistance of the nickel layer was improved to a higher level. The separation resistance of the nickel layer was improved to a further higher level when the length LB was greater than or equal to 0.80.

It has thus been shown by the above test results that it is preferable to control the length LB to be greater than or equal to 0.25 mm, more preferably greater than or equal to 0.40 mm, still more preferably greater than or equal to 0.80 mm, for improvement in separation resistance.

The entire contents of Japanese Patent Application No. 2012-235267 (filed on Oct. 25, 2012) are herein incorporated by reference.

Although the present invention has been described above with reference to the specific exemplary embodiment, the present invention is not limited to the above-described exemplary embodiment. Various modifications and variations of the embodiment described above will occur to those skilled in the art in light of the above teachings.

The ground electrode 27 is not necessarily formed into a bent shape although the ground electrode 27 is formed in a bent shape in the above embodiment. For example, the ground electrode 27 may alternatively be formed into a straight rod shape.

For further improvement in corrosion resistance, a trivalent chromate layer (containing 95 mass % or more of trivalent chromium based on the total mass of the chromium component) may be applied to the surface of the nickel layer 31.

A coating layer of anticorrosive oil containing at least one of carbon (C), barium (Ba), calcium (Ca), sodium (Na) and sulfur (S) may be applied to the surface of the nickel layer 31 (or, in the case where the trivalent chromate layer is formed on the nickel layer 31, to the surface of the trivalent chromate layer) for further improvement in corrosion resistance.

It is feasible, before the plating process for the formation of the nickel layer 31, to perform nickel strike treatment and thereby form a thin nickel strike layer on the surface of the ground electrode 27. The nickel strike treatment can be performed by a barrel plating process with the use of a strongly acidic aqueous plating solution (e.g. of pH 1 or less) containing $NiSO_4$ or $NiCl_2$, $H_3BO_3$, HCl etc. By this nickel strike treatment, impurities adhered to the surface of the ground electrode 27 can be removed to increase the adhesion of the nickel layer 31 to the ground electrode 27 for further improvement in corrosion resistance.

The application of the present invention is not limited to the above spark plug 1 where a spark discharge is generated in the spark discharge gap 30. The present invention is applicable to any other type of spark plug such as an alternating-current plasma spark plug where an alternating-current plasma is generated in a discharge gap by the application of an alternating-current power.

Either or both of the tips 28 and 29 may not be provided although the tips 28 and 29 are provided on the center electrode 5 and the ground electrode 27, respectively, in the above embodiment.

In the above embodiment, the ground electrode 27 is joined to the front end portion 26 of the metal shell 3. It is alternatively feasible to form the ground electrode 27 by cutting a part of the metal shell 3 (or a part of a front end metal part previously joined to the metal shell 3) (see e.g. Japanese Laid-Open Patent Publication No. 2006-236906).

Although the tool engagement portion 19 is hexagonal in cross section in the above embodiment, the shape of the tool engagement portion 19 is not limited to such a hexagonal cross-section shape. The tool engagement portion 19 may alternatively be formed into a Bi-HEX shape (modified dodecagonal shape) (according to ISO 22977: 2005(E)) or the like.

The scope of the invention is defined with reference to the following claims.

Having described the invention, the following is claimed:

1. A spark plug, comprising:

a cylindrical metal shell;

a ground electrode joined to a front end portion of the metal shell; and a nickel layer formed on the ground electrode, wherein the ground electrode has a base material exposed region in which a base material of the ground electrode is exposed; and wherein the nickel layer includes at least an outer-lateral-side nickel layer located on an outer lateral surface of the ground electrode so as to be adjacent to the base material exposed region of the ground electrode and satisfies a condition of LA≥25 μm, where LA is a length from a first part of the outer-lateral-side nickel layer having a thickness equal to 80% of a maximum thickness of the outer-lateral-side nickel layer to a second part of the outer-lateral-side nickel layer having a thickness equal to 20% of the maximum thickness of the outer-lateral-side nickel layer in a longitudinal direction of the ground electrode.

2. The spark plug according to claim 1, wherein the nickel layer satisfies a condition of LA≥50 μm.

3. The spark plug according to claim 2, wherein the nickel layer satisfies a condition of LA≥90 μm.

4. A spark plug, comprising:

a cylindrical metal shell;

a ground electrode joined to a front end portion of the metal shell; and a nickel layer formed on the ground electrode, wherein the ground electrode has a base material exposed region in which a base material of the ground electrode is exposed; and wherein the nickel layer includes at least an outer-lateral-side nickel layer located on an outer lateral surface of the ground electrode so as to be adjacent to the base material exposed region of the ground electrode and satisfies a condition of LB≥0.25 mm, where, assuming that the outer-lateral-side nickel layer has, at a first part thereof, a thickness equal to 80% of a maximum thickness of the outer-lateral-side nickel layer, LB is a length between points of the first part of the outer-lateral-side nickel layer located closest to and farthest away from a front end of the metal shell in a longitudinal direction of the ground electrode.

5. The spark plug according to claim 4, wherein the nickel layer satisfies a condition of LB≥0.40 mm.

6. The spark plug according to claim 5, wherein the nickel layer satisfies a condition of LB≥0.80 mm.

7. The spark plug according to claim 4, wherein the nickel layer satisfies a condition of LA≥25 μm, where LA is a length from the first part of the outer-lateral-side nickel layer to a second part of the outer-lateral-side nickel layer having a thickness equal to 20% of the maximum thickness of the outer-lateral-side nickel layer in the longitudinal direction of the ground electrode.

8. The spark plug according to claim 7, wherein the nickel layer satisfies a condition of LA≥50 μm.

9. The spark plug according to claim 8, wherein the nickel layer satisfies a condition of LA≥90 μm.

* * * * *